US005211223A

United States Patent [19]

Mulville

[11] Patent Number: 5,211,223

[45] Date of Patent: May 18, 1993

[54] DOWN HOLE OIL WELL HEATER EMPLOYING ELECTRO-THERMAL PAPER

[76] Inventor: Tim Mulville, P.O. Box 1302, Vernal, Utah 84078

[21] Appl. No.: 844,452

[22] Filed: Mar. 2, 1992

[51] Int. Cl.[5] ..... E21B 36/04

[52] U.S. Cl. ..... 166/60; 166/61; 166/902

[58] Field of Search ..... 166/60, 61, 65.1, 902

[56] References Cited

U.S. PATENT DOCUMENTS

| | | | |
|---|---|---|---|
| 2,754,912 | 7/1956 | Curson | 166/61 X |
| 3,781,526 | 12/1973 | Damron | 219/213 X |
| 4,374,312 | 2/1983 | Damron | 219/213 X |
| 4,446,917 | 5/1984 | Todd | 166/61 X |
| 4,538,682 | 9/1985 | McManus et al. | 166/60 X |

*Primary Examiner*—Terry Lee Melius

*Attorney, Agent, or Firm*—Mallinckrodt & Mallinckrodt

[57] ABSTRACT

A down-hole oil well heater for improved recovery of oil includes a heating element comprising a sheet of electrically conductive paper which generates heat as a result of resistance to current flow therethrough and spaced apart, primary conductor elements preferably in the form of thin metal strips attached, as by sewing, to the conductive paper to provide uniform distribution of current flow through the paper from one conductor element to the other. Secondary conductor elements are electrically connected to said primary conductor elements and controller means are electrically connected to such secondary conductor elements for controlling the flow of electricity to the electrically conductive paper. The heating element covers a portion of conventional oil well tubing and is sandwiched between layers of electrically nonconductive, insulating material.

9 Claims, 1 Drawing Sheet

DOWN HOLE OIL WELL HEATER EMPLOYING ELECTRO-THERMAL PAPER

BACKGROUND OF THE INVENTION

1. Field

The present invention relates to apparatus and methods for producing crude oil having poor flowability from subterranean formations.

2. State of the Art

Crude oil is produced by conducting it from subterranean formations through wells to the surface. A commonly observed phenomenon in the production of crude oil is the deposition of paraffin onto the walls of production tubing or the wellbore. Such deposition reduces the cross-sectional area of the conductive pathway thereby restricting the flow of the crude oil.

One way of dealing with this problem has been to pump hot fluid down the well so as to dissolve the paraffin and reopen the conductive pathway of the well. However, such an operation is expensive. Heating the fluid consumes considerable energy and much manpower is expended in operating the system.

Electro-thermal paper is a thin, highly flexible sheet material for low-cost electrical resistance heating that has been available for some time. Electro-thermal paper has several advantages. It can produce heat over an area of any size and configuration. Because it contains no wires or metal in the material, it is free of localized hot spots and consequent breakage problems. It can also be bent around a ¼inch radius with little effect on its electrical properties. The type of paper used and the method of its manufacture is disclosed in U.S. Pat. Nos. 3,781,526 and 4,374,312 both to Damron.

The paper is also relatively durable depending on the temperature at which it is used. At 150 degrees Fahrenheit, for example, its stability is measured in tens of years. At 200 degrees Fahrenheit, its stability is measured in months. Heretofore, so far as is known by applicant, no one has applied electro-thermal paper technology to oil well production and to the problem o paraffin deposition.

SUMMARY OF THE INVENTION

In accordance with the invention, it has been recognized that the application of electro-thermal paper technology to the field of oil well heating could provide a low cost solution to the problem of paraffin clogged oil wells. Accordingly, an effective down-hole oil well heater for improved recovery of oil has been developed.

The heater of the invention includes a heating element comprising a sheet of electro-thermal paper which generates heat as a result of resistance to current flow therethrough. The heating element includes spaced apart, primary conductor elements in the form of thin metal strips which are attached, preferably by sewing, to the conductive paper to provide uniform distribution of current flow through the paper from one conductor element to the other. The heating element is wrapped around conventional oil well tubing and is sandwiched between layers of electrically nonconductive, insulating material.

If the tubing is made of an electrically nonconductive insulating material such as fiberglass the sheet of electro-thermal paper can be wrapped directly around such tubing. However, if the tubing is metal such as standard steel tubing, then a layer of electrically nonconductive insulating material must be applied to the tubing before wrapping it with the electro-thermal paper, so as to prevent the electro-thermal paper and thin metal strips from shorting out through electrical contact with the steel.

The sheet of electro-thermal paper extends around the tubing preferably up to but not including 360 degrees. It is advantageous to leave a gap of about 0.25 inches between confronting edges of said sheet of electro-thermal paper for a reason that will appear hereinafter.

Secondary electrical conductors penetrate the outer casing of electrical insulating material which are electrically connected with the metal foil conductors by an electrical connecting means. A controller means for regulating electrical power supply to the electro-thermal paper to maintain the temperature of the electro-thermal paper at a desired level is electrically connected to the electrical conductors. If the power supply is controlled so that the temperature of the electro-thermal paper is maintained at around 150° Fahrenheit, the life of the electro-thermal paper is measured in tens of years.

THE DRAWINGS

The best mode presently contemplated for carrying out th invention in actual practice is illustrated in the accompanying drawings, in which:

FIG. 1 represents a view in side elevation of a down-hole oil well heater according to the invention in place in the ground with an intermediate section of the outer fiberglass casing removed;

FIG. 2, a view in transverse section of the down-hole oil well heater of FIG. 1 taken along line 2—2 of FIG. 1; and FIG. 3, a fragmentary vertical section taken along line 3-3 of FIG. 2 and drawn to a slightly larger scale.

DETAILED DESCRIPTION OF THE ILLUSTRATED EMBODIMENT

Figure 2:
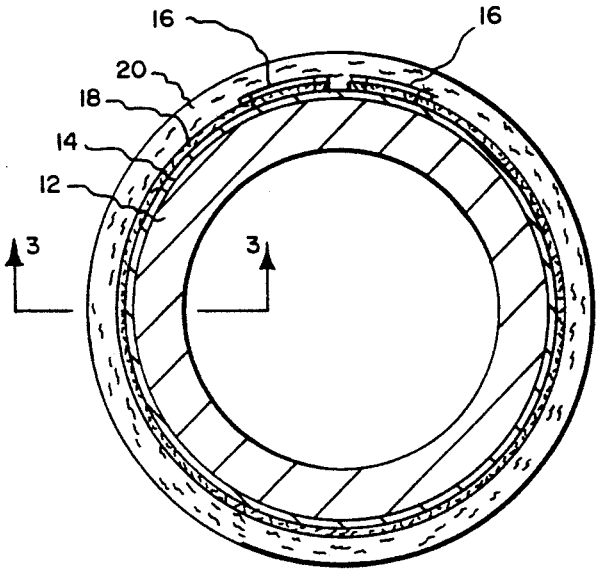
Figure 3:
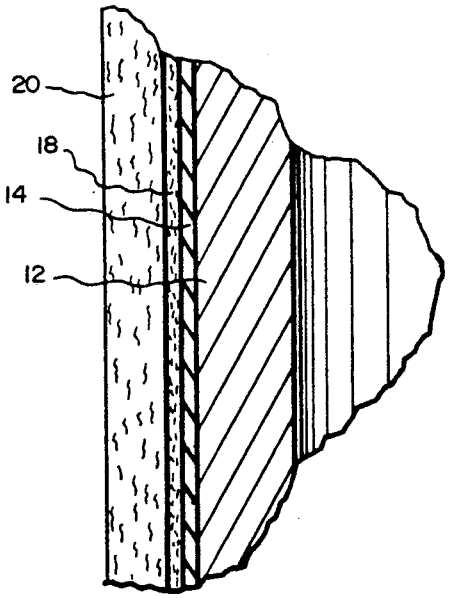

In the form illustrated, the down-hole oil well heater 10 is fabricated around a length of conventional steel oil well tubing 12. However, the tubing can be of other materials such as fiberglass instead of steel. If metal tubing is used, it is preferably sand blasted to remove any rust and to provide a clean, abraded surface for application of a layer of nonconductive electrical insulating material, here shown as rubber membrane 14 in FIGS. 2 and 3. A preferred electrical insulating material is Dow-Corning 3-5000 applied as a liquid to a thickness of preferably about 0.025 inches. The liquid quickly cures to form a heat-dissipating rubber membrane. Other heat-dissipating rubber membranes are available and are preferred over heat absorbing types of rubbers.

At least a pair of thin elongate metal foil conductors, here shown as copper strips 16, are attached to a sheet of electro-thermal paper 18. The preferred way of attaching the metal foil conductors is to sew them onto the paper as disclosed by Damron, U.S. Pat. No. 4,374,312. However, bonding agents or adhesives can be used instead of sewing. The sheet of electro-thermal paper 18 having the primary metal foil conductors is then applied over the area of the tubing covered by the electrically nonconductive insulating material. As this is preferably done before the insulating material has cured, it is advantageous to leave about a 0.25 inch gap 20 between confronting edges of the sheet so that excess material can escape.

Figure 1:
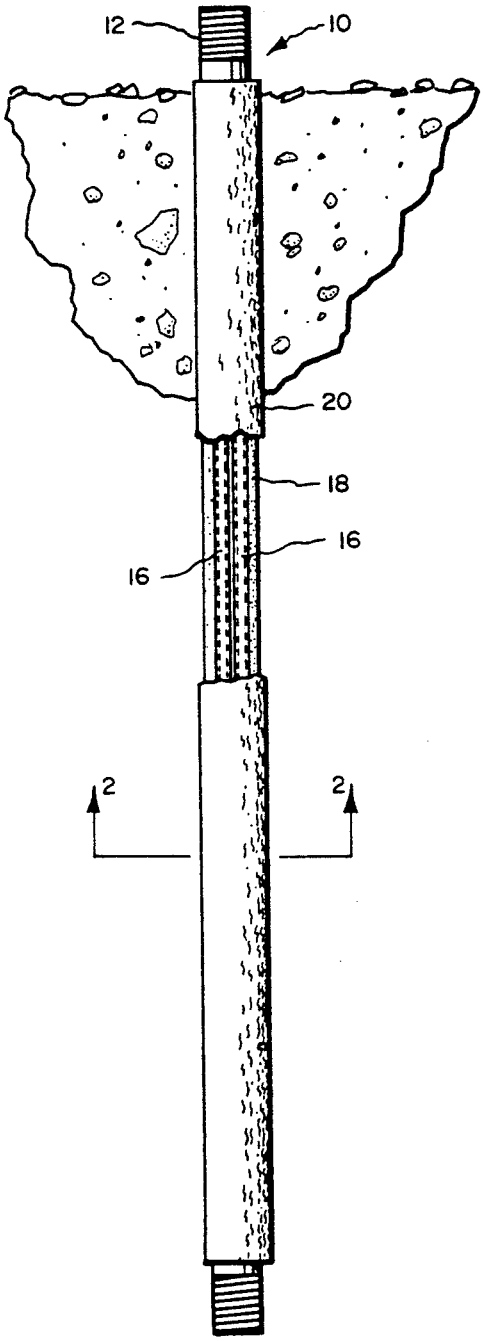

The pair of copper strips 16 are preferably disposed longitudinally on the electro-thermal paper along opposite margins along the gap, as shown in FIG. 1. The spaced apart copper strips provide uniform distribution of current flow through the paper from one conductor to the other. If desired, a third copper strip or even more can be interposed longitudinally between the pair of marginal strips 16 on the electro-thermal sheet.

The tubing 12, the sheet of electro-thermal paper 18, the copper strips 16, a thermocouple (not shown), if any, for controlling power supply to the copper strips, and the rubber membrane 14, if any, comprise the inner assembly of the downhole oil well heater.

An outer casing of electrically nonconductive, insulating material, here shown as fiberglass 21, is applied over the inner assembly. Fiberglass is the preferred insulating material if the insulating material is to be the outer casing. However, if the heating element is to be encased in a steel jacket, such as the type of steel jacket employed to construct hydraulic tubing, then the electro-thermal paper preferably has an outer coating of Dow-Corning 3-5000 instead of fiberglass. Regardless of whether simple steel or fiberglass tubing is used or whether steel jacketed hydraulic tubing is used, the electro-thermal paper is sandwiched between inner and outer layers of electrically nonconductive insulating material.

The application of the fiberglass is simplified if done before electrical conductors (not shown) are connected to the metal foil conductors 16. However, applying the fiberglass first requires that the connector site on the metal foil conductors and the attachment site for the thermocouple, if any, be protected from the fiberglass. This can be done by applying wax to preferably a one inch section of each metal foil conductor and to preferably one square inch of the electro-thermal paper for the attachment of a thermocouple. A waxed, preferably square wood cover is then place over these waxed areas. After the fiberglass is applied and cured, the fiberglass over these wood covers is ground off and the wood covers removed. Then electrical conductors (not shown), i.e., wires, are connected to the metal foil conductors and the thermocouple is attached to the electro-thermal paper.

If the down-hole oil well heater is constructed using metal tubing, precautions are taken to ensure that the electro-thermal paper does not come into contact with the metal. For example, if a thirty foot length of tubing is used, the layer of electrical insulating material is applied over about twenty-seven and one half feet. The sheet of electro thermal paper used for such length of tubing is preferably about twenty-seven feet, leaving about three inches of extra electrical insulating material at either end of the heater. The outer casing of fiberglass is then applied to about twenty-eight feet of the tubing so as to completely cover the sheet of electro-thermal paper, the rubber membrane, and to attach to about three inches or so of the metal tubing at either end beyond the rubber membrane. The fiberglass penetrates and bonds to the electro-thermal paper. Consequently, a solid attachment between the fiberglass and the tubing is formed which prevents the electro-thermal paper from turning on the tubing.

Returning to the electrical connection. The power source can be 110/120 vOlt or 220/240 Volt. For both 110/120 volt and 220/240 volt preferably three metal foil conductors are attached to the electro-thermal paper and connected at one end to the wires of the power source. The power source must be controlled by some type of controller means for regulating the power supply to the electro-thermal paper to maintain the temperature of the electro-thermal paper at a desired level, preferably at or under 150° fahrenheit. The controller means can be a thermocouple attached to the electro-thermal paper as already mentioned.

However, other equally suitable controller means are available which are not attached to the electro-thermal paper but simply interposed between the power source and the electrical conductors supplying electricity to the metal foil conductors. Examples of such controller means include a Slick-100 device manufactured by Allen Bradley of Milwaukee, Wi. and a variac such as the type manufactured by Staco Energy Products, Co. of Dayton, Oh.

Whereas this invention is here illustrated and described with reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. A down-hole oil well heater comprising:

a heating element covering a portion of oil well tubing and including a sheet of electro-thermal paper leaving a gap between confronting edges thereof and at least a pair of spaced apart primary conductor elements attached to said electro-thermal paper;

inner and outer layers of electrically nonconductive insulating material sandwiching said electro-thermal paper;

secondary electrical conductors penetrating said outer layer of electrically nonconductive insulating material;

electrical connection means electrically connecting said primary and secondary conductor elements together; and a controller means for regulating electrical power supply to the electro-thermal paper to maintain the temperature of the electro-thermal paper at a desired level, said controller means being electrically connected to said secondary electrical conductors.

2. A down-hole oil well heater according to claim 1, wherein the tubing is metal and electrical insulating material covers a portion of the length of said tubing and said sheet of electro-thermal paper covers said portion of tubing covered by said electrical insulating material except for a gap between confronting edges of said paper.

3. A down-hole oil well heater according to claim 1 wherein metal foil conductor strips are oriented longitudinally along opposite margins along the gap between confronting edges of the electro-thermal sheet.

4. A down-hole oil well heater according to claim 1, wherein the controller means is a thermocouple attached to the electro-thermal paper.

5. A down-hole oil well heater according to claim 1, wherein the controller means is a variac interposed between the power supply and the electrical conductors.

6. A down-hole oil well heater according to claim 1, wherein the controller means is a Slick-100 interposed between the power supply and the electrical conductors.

7. A down-hole oil well heater according to claim 1, wherein the outer casing is fiberglass.

8. A down-hole oil well heater according to claim 1, wherein the heating element is contained in the hydraulic fluid chamber of a section of steel hydraulic tubing.

9. A down-hole oil well heater consisting of:

a heating element covering a portion of oil well tubing including a sheet of electro-thermal paper; at least a pair of spaced apart primary conductor elements, said electro-thermal paper being interposed between inner and outer layers of electrically nonconductive insulating material;

secondary electrical conductors penetrating said outer layer of electrically nonconductive insulating material and electrically connected with said primary conductor elements by an electrical connection to said primary conductor elements; and a controller means for regulating electrical power supply to the electro-thermal paper to maintain the temperature of the electro-thermal paper at a desired level, said controller means electrically connected to said secondary electrical conductors.

* * * * *